US008618391B1

(12) United States Patent
Roberts

(10) Patent No.: US 8,618,391 B1
(45) Date of Patent: Dec. 31, 2013

(54) NITRIDE SLIDE

(76) Inventor: Jeffrey A. Roberts, Apple Valley, MN (US)

( * ) Notice: Subject to any disclaimer, the term of this patent is extended or adjusted under 35 U.S.C. 154(b) by 121 days.

(21) Appl. No.: 13/349,497

(22) Filed: Jan. 12, 2012

(51) Int. Cl.
*G10D 3/00* (2006.01)

(52) U.S. Cl.
USPC ..... 84/319; 84/315

(58) Field of Classification Search
USPC ..... 84/315, 319
See application file for complete search history.

(56) References Cited

U.S. PATENT DOCUMENTS

| | | | |
|---|---|---|---|
| 587,089 | A | 7/1897 | Duck |
| 1,259,062 | A | 3/1918 | Wilber |
| 1,280,858 | A | 10/1918 | Russell |
| 1,280,959 | A | 10/1918 | Campton |
| 1,302,451 | A | 4/1919 | Tanquary |
| 1,342,718 | A | 6/1920 | Neft |
| 1,372,254 | A | 3/1921 | Shutt |
| 1,492,274 | A | 4/1924 | Sullivan |
| 1,601,429 | A | 9/1926 | Carpenter |
| 1,618,884 | A | 2/1927 | Meyer |
| 1,691,945 | A | 11/1928 | Timm |
| 1,748,053 | A | 2/1930 | Blair |
| 1,834,252 | A | 12/1931 | Morgan |
| 1,837,270 | A | 12/1931 | Kailimai |
| 1,904,335 | A | 4/1933 | Stevens |
| 1,909,456 | A | 5/1933 | Carter |
| 1,926,561 | A | 9/1933 | Schrickel |
| 2,021,641 | A | 11/1935 | Spina |
| 2,025,786 | A | 12/1935 | Spina |
| 2,026,354 | A | 12/1935 | Mihalek |
| 2,027,937 | A | 1/1936 | Schrickel |
| 2,030,241 | A | 2/1936 | Comons |
| 2,073,331 | A | 3/1937 | Allen |
| 2,082,683 | A | 6/1937 | Carter |
| 2,184,733 | A | 12/1939 | Burgien |
| 2,186,399 | A | 1/1940 | Abbott |
| 2,195,521 | A | 4/1940 | Rebsamen |
| 2,203,466 | A | 6/1940 | Lawrence |
| 2,248,542 | A | 7/1941 | McDaniel et al. |
| 2,392,937 | A | 1/1946 | McDaniel |
| 2,416,854 | A | 3/1947 | Smith |
| 2,435,512 | A | 2/1948 | Richmond |
| 2,441,713 | A | 5/1948 | Miller |
| 2,449,032 | A | 9/1948 | Yates |
| 2,466,344 | A | 4/1949 | Wright |
| 2,485,108 | A | 10/1949 | Peasley |
| 2,490,517 | A | 12/1949 | Garcia |
| 2,490,865 | A | 12/1949 | Engles |
| 2,493,698 | A | 1/1950 | Schwartz |
| 2,496,191 | A | 1/1950 | Zipperstein et al. |
| 2,647,429 | A | 8/1953 | Smith |
| 2,650,513 | A | 9/1953 | Miller |

(Continued)

*Primary Examiner* — Robert W Horn
(74) *Attorney, Agent, or Firm* — Albert W. Watkins

(57) ABSTRACT

A guitar slide has a core that consists essentially of a metal composition which is susceptible to the formation of nitrides and carbides of the metal composition upon proper exposure to carbon and nitrogen. A diffusion layer circumscribes the core and consists essentially of nitrides and carbides of the metal composition. A compound layer circumscribes the diffusion layer and consists essentially of the metal composition, nitrogen, and oxygen. In one physical embodiment, the guitar slide includes a generally tubular body having a conical outer surface tapering downward from a first open finger receiving end to a second smaller end. The outer surface and the inner surface are both preferably conical. In another physical embodiment, the guitar slide is provided with a domed end. Other physical embodiments are also disclosed.

7 Claims, 1 Drawing Sheet

(56) References Cited

U.S. PATENT DOCUMENTS

| | | | | | |
|---|---|---|---|---|---|
| 3,194,104 | A | | 7/1965 | Rhodes et al. | |
| 3,386,325 | A | | 6/1968 | Smith | |
| 3,457,822 | A | | 7/1969 | Mull | |
| D222,111 | S | | 9/1971 | De Masi | |
| 3,638,525 | A | * | 2/1972 | Sciurba et al. | 84/319 |
| 3,741,065 | A | | 6/1973 | Harris | |
| 3,822,629 | A | | 7/1974 | Smith | |
| 3,854,368 | A | | 12/1974 | Pogan | |
| 3,922,945 | A | | 12/1975 | Pettijohn | |
| D248,122 | S | | 6/1978 | Heet | |
| 4,092,894 | A | | 6/1978 | Clough, Jr. | |
| 4,171,659 | A | | 10/1979 | Tumminaro | |
| 4,197,780 | A | | 4/1980 | Smith | |
| 4,328,733 | A | | 5/1982 | Smith | |
| 4,471,682 | A | | 9/1984 | Bozung | |
| 4,563,934 | A | | 1/1986 | Keizer | |
| 4,817,488 | A | | 4/1989 | de los Santos | |
| 4,969,382 | A | | 11/1990 | Hein, III et al. | |
| 5,251,527 | A | | 10/1993 | Roberts | |
| D360,647 | S | | 7/1995 | Jimenez | |
| 5,450,778 | A | | 9/1995 | Roberts | |
| 5,458,036 | A | | 10/1995 | Monaco | |
| 5,488,891 | A | | 2/1996 | Baker | |
| 5,492,046 | A | | 2/1996 | Jimenez | |
| 5,515,762 | A | | 5/1996 | Perkins et al. | |
| 5,553,527 | A | * | 9/1996 | Harrison | 84/319 |
| 5,902,944 | A | | 5/1999 | Grossman | |
| 5,981,856 | A | | 11/1999 | Story | |
| 6,111,177 | A | | 8/2000 | Pattillo | |
| 6,160,212 | A | | 12/2000 | Morse | |
| 6,242,676 | B1 | * | 6/2001 | Romero | 84/315 |
| 6,297,435 | B1 | | 10/2001 | Gutowski | |
| 6,369,307 | B1 | | 4/2002 | Wells | |
| 6,734,349 | B1 | | 5/2004 | Adams | |
| 7,375,268 | B1 | | 5/2008 | Thornhill | |
| 7,476,792 | B1 | | 1/2009 | Musser | |
| 7,557,283 | B1 | | 7/2009 | Moncrief | |
| 7,572,964 | B2 | | 8/2009 | Sundby | |
| 7,829,774 | B2 | | 11/2010 | Moncrief | |

* cited by examiner

NITRIDE SLIDE

BACKGROUND OF THE INVENTION

1. Field of the Invention

The present invention pertains generally to fingering devices such as stopping fingers or blocks for stringed musical instruments, and more particularly to a guitar slide having an improved surface treatment, yielding an improved tonality. In one embodiment, a conical body fabricated from a base material and then treated tapers from the base to a narrower end at the fingertip. In another embodiment of the present invention, a body with a domed end is fabricated from a base material and then treated to provide a guitar slide.

2. Description of the Related Art

While mankind has certainly always needed to pursue the basic necessities, life is much easier and more enjoyable when simple pleasures are included. Perhaps with man's first breaths came the realization that he had the capacity to produce sound, and with those first sounds, music was born. Throughout the ages, a wide variety of instruments have been developed to extend and enhance the auditory pleasures, each with unique sounds and characteristics.

Many of these ancient and modern instruments have strings that are tensioned. For many centuries, stringed musical instruments have brought pleasure to musicians and audiences alike. In accord with well-known physical laws and theories, these strings resonate when struck, plucked or otherwise disturbed. The frequency of resonance, which we know commonly as the note being played, is determined primarily by the free length of the string and the tension within the string. Different sounds originate from differing string materials and thicknesses or diameters.

Since music is often more enjoyable with some degree of variability and complexity, many stringed musical instruments have been designed to permit the musician to change one or both of the length and tension of the strings, and to thereby vary the frequency or tone produced when the string is disturbed or plucked. For exemplary purposes, most modern guitars have a fretted fingerboard that allows the musician to press down on a string at different positions along the string, and in so doing, selectively vary the note that the string produces when plucked or otherwise disturbed. In addition to directly, manually pressing on the string, other adjunctive devices have been designed such as slides. Slides are most commonly designed to be held against one or more strings, and the slide can be not only pressed against and withdrawn from the strings, but also slid about to vary the sound as desired, for example to produce a glissando sound.

Many types of slides have been used to obtain the slide blues sound on the guitar. This technique was developed from early one-stringed instruments, where the player would use a rock or pill bottle as a slider. Guitar players later used knives or broken-off necks of bottles.

Exemplary U.S. patents showing early conceptions, the teachings of each which are incorporated herein by reference, include U.S. Pat. No. 587,089 by Duck, entitled "Musical instrument"; U.S. Pat. No. 1,259,062 by Wilber, entitled "Stringed musical instrument"; U.S. Pat. No. 1,280,858 by Russell, entitled "Hawaiian guitar steel"; U.S. Pat. No. 1,280,959 by Campton, entitled "Guitar steel"; U.S. Pat. No. 1,302,451 by Tanquary, entitled "Fretting device for musical instruments"; U.S. Pat. No. 1,342,718 by Neft, entitled "Steel for guitars"; U.S. Pat. No. 1,372,254 by Shutt, entitled "Glass tone-bar for playing the guitar and similar stringed musical instruments"; U.S. Pat. No. 1,492,274 by Sullivan, entitled "Bar for stringed instruments"; U.S. Pat. No. 1,601,429 by Carpenter, entitled "Steel for musical instruments"; U.S. Pat. No. 1,618,884 by Meyer, entitled "Bar for guitars"; U.S. Pat. No. 1,691,945 by Timm, entitled "Fingering steel for guitars and similar stringed instruments"; U.S. Pat. No. 1,748,053 by Blair, entitled "Apparatus for playing stringed instruments"; U.S. Pat. No. 1,834,252 by Morgan, entitled "Guitar tone bar"; U.S. Pat. No. 1,837,270 by Kailimai, entitled "Steel for stringed musical instruments"; U.S. Pat. No. 1,904,335 by Stevens, entitled "Tone bar"; U.S. Pat. No. 1,909,456 by Carter, entitled "Steel for guitars and the like"; U.S. Pat. No. 1,926,561 by Schrickel, entitled "Guitar attachment"; U.S. Pat. No. 2,021,641 by Spina, entitled "Finger bar for use with stringed musical instruments"; U.S. Pat. No. 2,025,786 by Spina, entitled "Finger bar for use with stringed musical instruments"; U.S. Pat. No. 2,026,354 by Mihalek, entitled "Tone bar for stringed musical instruments"; U.S. Pat. No. 2,027,937 by Schrickel, entitled "Tone bar"; U.S. Pat. No. 2,030,241 by Comons, entitled "Playing bar for hawaiian steel guitars"; U.S. Pat. No. 2,082,683 by Carter, entitled "Steel for musical instruments"; U.S. Pat. No. 2,184,733 by Burgien, entitled "Steel for musical instruments"; U.S. Pat. No. 2,186,399 by Abbott, entitled "Guitar steel"; U.S. Pat. No. 2,195,521 by Rebsamen, entitled "Musical instrument"; U.S. Pat. No. 2,203,466 by Lawrence, entitled "Steel for hawaiian guitars"; U.S. Pat. No. 2,248,542 by McDaniel et al, entitled "Fingering steel for guitars"; U.S. Pat. No. 2,392,937 by McDaniel, entitled "Hawaiian electric guitar steel"; U.S. Pat. No. 2,416,854 by Smith, entitled "Steel for hawaiian guitars"; U.S. Pat. No. 2,435,512 by Richmond, entitled "Guitar steel"; U.S. Pat. No. 2,441,713 by Miller, entitled "Bar or slide for playing certain musical instruments"; U.S. Pat. No. 2,449,032 by Yates, entitled "Playing bar"; U.S. Pat. No. 2,466,344 by Wright, entitled "Guitar steel"; U.S. Pat. No. 2,485,108 by Peasley, entitled "Guitar bar or steel having a rotating contact face"; U.S. Pat. No. 2,490,517 by Garcia, entitled "Tone bar for guitars and the like"; U.S. Pat. No. 2,490,865 by Engles, entitled "Bar for stringed instruments"; U.S. Pat. No. 2,493,698 by Schwartz, entitled "Thimble grip swivel bar for guitars"; U.S. Pat. No. 2,496,191 by Zipperstein et al, entitled "Guitar steel"; U.S. Pat. No. 2,647,429 by Smith, entitled "Guitarist's steel bar"; U.S. Pat. No. 2,650,513 by Miller, entitled "Guitar steel"; U.S. Pat. No. 3,194,104 by Rhodes et al, entitled "Playing bar for electric stringed musical instruments"; U.S. Pat. No. 3,386,325 by Smith, entitled "Slide bar for hawaiian guitar"; U.S. Pat. No. 3,457,822 by Mull, entitled "Steel guitar, steels and method"; U.S. Pat. No. 3,822,629 by Smith, entitled "Slide bar apparatus for guitar"; U.S. Pat. No. 3,854,368 by Pogan, entitled "Finger mountable guitar string contact device"; U.S. Pat. No. 3,922,945 by Pettijohn, entitled "Hand held chord fingering device for guitar"; U.S. Pat. No. 4,092,894 by Clough, Jr., entitled "Musical slide"; U.S. Pat. No. 4,171,659 by Tumminaro, entitled "Electrified guitar accessory"; U.S. Pat. No. 4,197,780 by Smith, entitled "Method and apparatus for stabilizing the tension of musical instrument strings"; U.S. Pat. No. 4,328,733 by Smith, entitled "Slide bar holder device for Hawaiian guitar"; U.S. Pat. No. 4,471,682 by Bozung, entitled "Automatic chording device for guitars and similar instruments"; U.S. Pat. No. 4,563,934 by Keizer, entitled "Capo-tremolo-slide attachment for guitars"; U.S. Pat. No. 4,817,488 by de los Santos, entitled "Guitar slide bar apparatus"; U.S. Pat. No. 5,488,891 by Baker, entitled "Slide bar for stringed musical instruments"; U.S. Pat. No. 5,492,046 by Jimenez, entitled "Finger-mounted, rotatable slide for a stringed musical instrument"; U.S. Pat. No. 5,515,762 by Perkins et al, entitled "Guitar slide"; U.S. Pat. No. 5,902,944 by Grossman, entitled "Finger-controlled means for contacting strings on a guitar"; U.S. Pat. No. 5,981,856 by Story, entitled "Slide system for a stringed musical instrument"; U.S. Pat. No. 6,111,177 by Pattillo, entitled "Slide bar devices and assemblies"; U.S. Pat. No. 6,160,212 by Morse, entitled "Guitar slide"; U.S. Pat. No. 6,242,676 by Romero, entitled "Stringed instrument slide"; U.S. Pat. No. 6,297,435 by Gutowski, entitled "Method and apparatus for manually modulating wavelength and manipulating sound for stringed instruments"; U.S. Pat. No. 6,369,307 by Wells, entitled "Device for forming chords"; U.S. Pat. No. 6,734,349 by Adams, entitled "Fingertip musical tap assembly"; U.S. Pat. No. 7,375,268 by Thornhill, entitled "Machine with which stringed instruments will be picked or plucked"; U.S. Pat. No. 7,557,283 by Moncrief, entitled "Guitar slide"; U.S. Pat. No. 7,572,964 by Sundby, entitled "Guitar-slide ring"; U.S. Pat. No. 7,829,774 by Moncrief, entitled "Guitar slide"; Des 222,111 by De Masi, entitled "Chord-producing finger bar for a stringed musical instrument or similar article"; Des 248,122 by Heet, entitled "Hand held musical string vibration initiator and sustainer"; and Des 360,647 by Jimenez, entitled "Slide guide for guitar".

In addition to the shape, the material used in both the string and the slide will also substantially change the sound of the instrument. Additionally, the surface finish will also alter the sound. Nearly all of these aforementioned prior art devices are fabricated from a single homogenous material such as wood, steel, brass, bronze, porcelain or glass, though a few of the slides also propose various plastics, ceramics or even a felt or rubber contact surface. Modern guitar players still use wine bottle tops. Various other materials have been used, such as metal socket wrenches or plexi-glass slides. The various materials and surface finishes give different sounds and feels to the player. For exemplary purposes, glass is commonly recognized as producing a purer and cleaner sound, while metal is more of a "dirty" or "blues" sound.

Many attempts have been made to improve upon these traditional devices. One device, shown in U.S. Pat. No. 3,741,065 to Harris, issued Jun. 26, 1973 and entitled "Guitar slide bar apparatus", the contents and teachings which are incorporated herein by reference, shows an outwardly tapering body which is wider at the finger tip end. This device teaches removable inserts for finger sizing. A convex slide is illustrated in U.S. Pat. No. 4,969,382 to Hein, III, et al., issued Nov. 13, 1990 and entitled "Pitch changing device for guitar", the contents and teachings which are incorporated herein by reference. The convex exterior is designed for selectively depressing certain strings. Once again it does not have the naturally tapered shape of the finger and plays differently from traditional slides.

U.S. Pat. No. 2,073,331 by Allen, entitled "Tone bar" the contents and teachings which are incorporated herein by reference, proposes a fiber sleeve surrounding a heavy metal bar, the prupose which is disclosed as "eliminating the raucous metallic sound usually produced".

U.S. Pat. No. 3,638,525 by Sciurba et al, entitled "Finger glide bar", and U.S. Pat. No. 5,553,527 by Harrison, entitled "Micro smooth guitar slide", the contents and teachings which are incorporated herein by reference, each teach a highly polished surface such as by plating and polishing.

U.S. Pat. No. 5,458,036 by Monaco, entitled "Bottleneck slide bar with sectors of different materials", the contents and teachings which are incorporated herein by reference, describes a slide made from a plurality of different materials joined to form a hollow cylinder. Sounds characteristic of each material may then be produced, and unique sounds are achieved at the interface between two adjacent and different materials.

U.S. Pat. No. 7,476,792 by Musser, entitled "Versatile finger ring guitar slide with variable bar length", the contents and teachings which are incorporated herein by reference, proposes a hard smooth surface "formed from glass or similarly hard material including ceramic, jade and other stone-like coating. While an improvement, the Musser patent teaches the combination of hard and smooth surfaces, and is thereby limited.

In addition to the foregoing documents, U.S. Pat. Nos. 5,251,527 entitled "Guitar slide" and 5,450,778 entitled "Guitar slide" by the present inventor are also incorporated herein by reference in entirety. Webster's New Universal Unabridged Dictionary, Second Edition copyright 1983, is also incorporated herein by reference in entirety for the definitions of words and terms used herein.

SUMMARY OF THE INVENTION

The present invention is a guitar slide which plays naturally, following the shape of the human finger, while giving the proper tone without noise or a buzz. A novel treatment is applied that produces substantially improved sound, while not being associated with the drawbacks common to the materials of the prior art.

In a first manifestation, the invention is a slide operatively contacting strings of a stringed musical instrument played by a musician. A solid generally tubular core consists essentially of a metal composition that is susceptible to the formation of nitrides and carbides of the metal composition upon proper exposure to carbon and nitrogen. A diffusion layer circumscribes the core and consists essentially of nitrides and carbides of the metal composition. A compound layer circumscribes the diffusion layer and consists essentially of the metal composition, nitrogen, and oxygen.

In a second manifestation, the invention is a guitar slide. A solid generally tubular core consists essentially of a metal composition that is susceptible to the formation of nitrides and carbides of the metal composition upon proper exposure to carbon and nitrogen. A diffusion layer circumscribes the core and consists essentially of nitrides and carbides of the metal composition. A compound layer circumscribes the diffusion layer and consists essentially of the metal composition, nitrogen, and oxygen.

In a third manifestation, the invention is a method of manufacturing a guitar slide. The method comprises the steps of machining a solid generally tubular core consisting essentially of a metal composition that is susceptible to the formation of nitrides and carbides of the metal composition upon proper exposure to carbon and nitrogen into a final geometry of the guitar slide; immersing the machined solid generally tubular core in a heated salt bath to operatively diffuse atoms of carbon and nitrogen interstitially into the machined solid generally tubular core; removing the machined solid generally tubular core from the heated salt bath; and quenching the machined solid generally tubular core to room temperature.

The general purpose of the present invention is a guitar slide which includes a generally tubular body having a conical outer surface tapering downward from a first open finger receiving end to a second smaller end. The outer surface and the inner surface are both preferably conical. In the preferred embodiment, the body is machined of solid steel, and then subsequently salt-bath nitrided. An alternative embodiment provides a guitar slide having a dome end for the actuation of notes individually.

A significant aspect and feature of the present invention is a flared shape which eliminates buzzing on the guitar strings. Another significant aspect and feature of the present invention is to provide the appropriate weight of the body to promote vibrato and make the slide easy to move. A further significant aspect and feature of the present invention is to provide a minimum diameter at a second end which allows accuracy in picking out particular strings. Still another significant aspect and feature of the present invention is to provide flared shape which holds the slide on the finger of the user, while allowing comfort where the radiused edges contact the hand. Yet a further significant aspect and feature of the present invention is to provide a structure of the present invention which may be made in various sizes to fit different fingers or different users. Yet another significant aspect and feature of the present invention is to provide a flared first section on the guitar slide which fits against adjacent fingers when in use so that the contact with the other finger maintains the guitar slide in position. Still yet another significant aspect and feature of the present invention is a guitar slide having a domed end for the actuation of individual notes.

OBJECTS OF THE INVENTION

A first object of the invention is to provide a guitar slide. A second object of the invention is to provide a guitar slide with a dome end. A further object of the invention is to obtain a unique sound which has not heretofore existed. Yet another object of the present invention is to obtain the improved sound and performance using ordinary stock material and proper fabrication.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which like reference numerals designate like parts throughout the figures thereof and wherein.

DESCRIPTION OF THE PREFERRED EMBODIMENT

Figure 1:
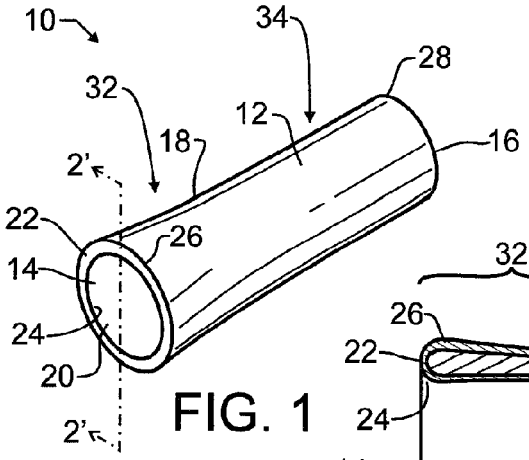
FIG. 1 illustrates a perspective view of a first preferred embodiment slide constructed according to the present invention.

A slide 10, constructed according to the present embodiment, includes a generally tubular body 12. The body 12 has a first open finger-receiving end 14 and a second end 16. The second end 16 is preferably open as in the illustrated embodiment. The body 12 has a generally conical shape. The body 12 has an outer surface 18 and an inner surface 20. The outer surface 18 and the inner surface 20 taper from first finger-receiving end 14 to the second end 16, preferably at an angle of 1 degree and 54 minutes. Those skilled in the art may vary this angle for particular finger fits.

In the illustrated embodiment, and for exemplary and non-limiting purposes only, the body 12 has a wall thickness at first finger-receiving end 14 of approximately 0.1525 inches, and a wall thickness at second end 16 of approximately 0.1125 inches.

Body 12 has a core 36 that is preferably machined of solid steel or an alloy thereof. A solid steel core 36 has sufficient weight to promote vibrato and allow ease of movement along the strings. Core 36 will most typically comprise low-carbon, low-alloy steels, but may alternatively be a medium or high-carbon steel. Exemplary steels include SAE 4100, 4300, 5100, 6100, 8600, 8700, 9300 and 9800 series, stainless steels, and some tool steels. While less preferred, cast iron, titanium, aluminum, molybdenum, and other metals and alloys thereof that are susceptible to the herein bellow described treatment to form nitrides and carbides upon proper exposure to carbon and nitrogen are contemplated as alternative core materials. Denser core materials provide a good tone on the strings and minimize noise. Lighter slides are susceptible to buzzing or noise.

Figure 2:
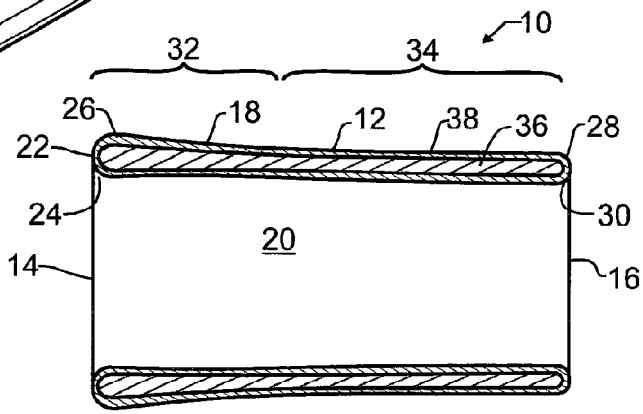
FIG. 2 illustrates a cross-sectional view taken along line 2-2 of FIG. 1.

At first finger-receiving end 14 of tubular body 12, there is a flat end section 22 extending around finger-receiving end 14 having a width of approximately 0.0625 inches. Tubular body 12 has an inner radiused edge 24 and an outer radiused edge 26. Edges 24 and 26 preferably have a 0.140 radius. At the second end 16, body 12 has an outer edge 28 which is machined at a tangent with a 0.047 radius. Body 12 has an inner edge 30 having a full 0.078 radius as illustrated in FIG. 2. In the preferred embodiment, body 12 is approximately 2.5 inches long.

FIG. 2 illustrates a cross-sectional view taken along line 2-2 of FIG. 1 where all numerals correspond to those elements previously described.

Treatment

In accord with the present invention, core 36 is treated with a salt bath of alkali cyanate or equivalently processed. For exemplary purposes only, and not solely limited thereto, the salt bath might be contained in a pot that has an aeration system. Treatment temperature is preferably maintained in the range between approximately 550 and 590° C. The salt bath and core 36 are preferably pre-heated to temperature, and then core 36 is submerged in the salt bath. Core 36, for exemplary purposes only and not limited solely thereto, may be treated for approximately four hours.

The cyanate thermally reacts with the surface of core 36 to form alkali carbonate. The bath is then treated to convert the carbonate back to a cyanate. During the treatment, atoms of carbon and nitrogen diffuse interstitially into core 36, creating barriers to slip, increasing the hardness and modulus near outer surface 18 and inner surface 20. The core exterior region 38 formed from the reaction has a compound layer and a diffusion layer that have been determined by the present inventor to produce minimal damping of vibration and excellent tone quality and timbre. The compound layer consists of iron, nitrogen, and oxygen, is abrasion resistant, and is stable at elevated temperatures. The diffusion layer contains nitrides and carbides.

A similar but alternative treatment process includes the foregoing treatment steps and may further include a preheat and an intermediate quench cycle. The intermediate quench is an oxidizing salt bath at approximately 400° C. This quench is held for approximately five to twenty minutes before final quenching to room temperature. The preheat and intermediate quench can assist by minimizing distortion and destroying any cyanate or cyanide residue left on core 36.

Preferably, material should not be removed after the salt bath treatment to preserve surface characteristics. The preferred treatment method alters only the chemical composition at or near the outer surface 18 and inner surface 20 and does not deposit an additional layer, so the preferred treatment method in accord with the present invention does not materially alter the dimensions of core 36.

Mode of Operation

In the preferred embodiment, body 12 has a first section 32 which tapers from the thickness described at finger-receiving end 14 to the narrower thickness. Body 12 has a second section 34 which has a constant thickness between section 32 and second end 16. In one preferred embodiment, outer surface 18 tapers through first section 32, and is generally constant in diameter through second section 34.

The structure of the present invention has many advantages over prior art devices. The flared shape eliminates buzzing on the guitar strings. The weight of core 36 promotes vibrato and makes slide 10 easy to move.

The minimum diameter at the second end 16 allows accuracy in picking out particular strings.

The flared shape holds slide 10 on the finger of a user, while allowing comfort where the radiused edges 24 and 26 contact the hand.

The structure of the present invention may be made in various shapes to fit different fingers or different users. For example, in the illustrated embodiment with the flared outer surface 18 and cylindrical inner surface 20, common diameters are 0.6875, 0.750, 0.8125, 0.875, 0.9375, and 1 inches.

Flared first section 32 of slide 10 fits against the adjacent finger when in use so that the contact with the other finger maintains slide 10 in position. Prior art cylindrical devices or outwardly tapered devices would be prone to slide off the finger when contacting adjacent fingers. Flared first section 32 fits nicely against adjoining fingers for a secure fit.

Description of a First Alternative Embodiment

Figure 3:
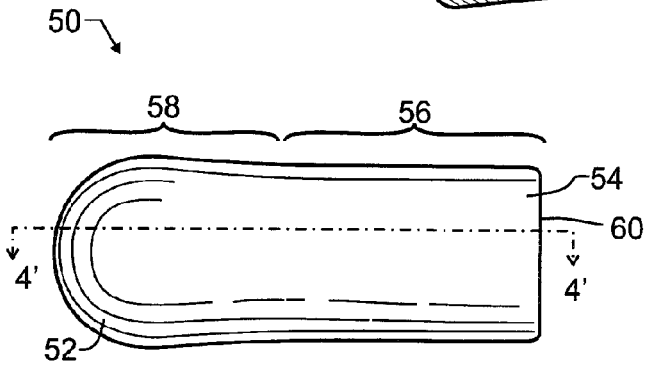
FIG. 3 illustrates a first alternative embodiment guitar slide having a dome end from a side view; and, FIG. 4 illustrates a cross-sectional view along line 4-4 of FIG. 3.

FIG. 3, a first alternative embodiment, illustrates a guitar slide 50 constructed in accordance with many of the features of the guitar slide 10 illustrated in FIG. 1, including the preferred salt-bath treatment process producing a core 36 and core exterior region 38, and which also includes a dome end 52. The one-piece body 54 is generally tubular in shape having a surface 56 being of constant diameter, which intersects another surface 58 which tapers and aligns between the constant diameter surface 56 and dome end 52 whose diameter conforms to that of the largest diameter of tapered surface 58. A finger receiving end 60 accommodates a finger of one's hand at one end of body 54.

Figure 4:
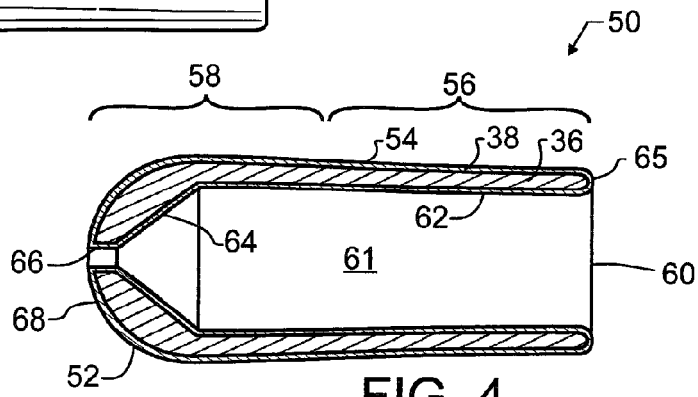

FIG. 4 illustrates a cross-sectional view along line 4-4 of FIG. 3 where all numerals correspond to those elements previously described. The interior 61 of body 54 includes a constant radius cylindrical surface 62, a conical surface 64 and a hole 66 extending from the interior through the dome end 52. The hole 66, extending through dome end 52 assists in easy removal of guitar slide 50 from one's finger should sweat tend to cause a hydraulic and/or pressure lock between the finger and interior 61 of guitar slide 50. Body 54 includes a radiused annular surface 65 at the edge of finger receiving end 60 to provide for comfortable fitting of one's finger at finger receiving end 60.

Mode of Operation of the First Alternative Embodiment

The interior 61 of the guitar slide 50 accommodates a finger of one's hand through finger receiving end 60. Downward fretting pressure is applied to guitar slide 50 to simultaneously depress the strings of the guitar or other fretted string instrument adjacent to a fret on the neck of an instrument. Often, individual notes are required to be played. For individual note playing, curved surface 68 is brought into contact with an individual string adjacent to an appropriate fret by tipping the cording hand finger upwardly subsequent to removing the constant diameter surface 56 and the tapered surface 58 from mass engagement with all of the guitar strings. Return to bar fretting occurs simply and rapidly by tipping the chording hand finger downwardly for engagement with the complete number of strings.

While the foregoing details what is felt to be the preferred embodiment of the invention, no material limitations to the scope of the claimed invention are intended. Further, features and design alternatives that would be obvious to one of ordinary skill in the art are considered to be incorporated herein. By way of the present disclosure, a variety of physical embodiments have been illustrated. Other physical embodiments suitable or preferable for a given application, instrument or musician are also understood to be incorporated herein, including but not solely limited to those illustrated in the patents incorporated herein above by reference. For exemplary purposes, and not solely limited thereto, the core may be solid and/or cylindrical, rather than the generally hollow tubular structure illustrated. Likewise, a variety of treatment methods have been illustrated, and other treatment methods to obtain like result that are suitable or preferable for a given application, instrument or musician are considered incorporated herein. The scope of the invention is set forth and particularly described in the claims herein below.

I claim:

1. A slide operatively contacting strings of a stringed musical instrument played by a musician, comprising:

a core consisting essentially of a metal composition that is susceptible to the formation of nitrides and carbides of said metal composition upon proper exposure to carbon and nitrogen;

a diffusion layer circumscribing said core and consisting essentially of nitrides and carbides of said metal composition; and a compound layer circumscribing said diffusion layer and consisting essentially of said metal composition, nitrogen, and oxygen.

2. The slide of claim 1 wherein said metal composition comprises iron.

3. The slide of claim 1, further comprising:

a solid generally tubular member comprising said core;

a first end on said solid generally tubular core including a dome over said first end;

a second end on said solid generally tubular core;

said solid generally tubular core having a first conical section tapering from a first diameter adjacent to said first end to a second narrower diameter; and, a second section adjacent said second end having a generally constant diameter.

4. The guitar slide of claim 1, further comprising:

a solid generally tubular member comprising said core; a first open end on said solid generally tubular core; a finger receiving second end on said solid generally tubular core; said solid generally tubular core having a first conical section tapering from a first diameter adjacent to the first end to a second narrower diameter; and, a second section adjacent the second end having a generally constant diameter.

5. A method of manufacturing a guitar slide, comprising the steps of:

machining a core consisting essentially of a metal composition that is susceptible to the formation of nitrides and carbides of said metal composition upon proper exposure to carbon and nitrogen into a final geometry of said guitar slide;

immersing said machined core in a heated salt bath to operatively diffuse atoms of carbon and nitrogen interstitially into said machined core;

removing said machined core from said heated salt bath; and quenching said machined core to room temperature.

6. The method of manufacturing a guitar slide of claim 5, wherein said step of immersing further comprises the steps of:

developing a diffusion layer circumscribing said core and consisting essentially of nitrides and carbides of said metal composition; and generating a compound layer circumscribing said diffusion layer and consisting essentially of said metal composition, nitrogen, and oxygen.

7. The method of manufacturing a guitar slide of claim 5, wherein said step of machining further comprises forming a first end on said core and leaving a dome over said first end.

* * * * *